US005988183A

United States Patent [19]

Huang

[11] Patent Number: 5,988,183

[45] Date of Patent: Nov. 23, 1999

[54] HAIR ORGANIZER

[76] Inventor: Tsu-Hsueh Huang, P.O. Box 82-144, Taipei, Taiwan

[21] Appl. No.: 09/240,670

[22] Filed: Feb. 2, 1999

[51] Int. Cl.[6] ..... A45D 8/00; A45D 2/00

[52] U.S. Cl. ..... 132/273; 132/275; 132/222; 132/210

[58] Field of Search ..... 132/273, 222, 132/275, 210, 212; D28/39, 40, 41; 2/174, 207, 171, 170

[56] References Cited

U.S. PATENT DOCUMENTS

| | | | |
|---|---|---|---|
| 537,542 | 4/1895 | Moore | 132/273 |
| 1,811,842 | 6/1931 | Bossart | 132/273 |
| 2,524,266 | 10/1950 | Licastro | 132/273 |
| 5,156,171 | 10/1992 | Goodman | 132/200 |
| 5,301,696 | 4/1994 | Revson | 132/273 |
| 5,303,723 | 4/1994 | Schach | 132/246 |
| 5,494,059 | 2/1996 | Barrows et al. | 132/273 |
| 5,553,631 | 9/1996 | Schach | 132/210 |
| 5,819,761 | 10/1998 | Sloan | 132/210 |
| 5,826,593 | 10/1998 | Haubrich | 132/273 |

*Primary Examiner*—Gene Mancene
*Assistant Examiner*—Philo Gene Pedro
*Attorney, Agent, or Firm*—A & J

[57] ABSTRACT

A hair organizer includes an envelope made of cloth and having an intermediate portion formed with a pocket by stitching; the pocket having a central portion formed with an opening, and an axial member having an intermediate portion formed with a slot, the axial member being fitted in the pocket with the opening stitched around an inner periphery of the slot, whereby one's long hair can be easily held in position without a hair clip.

1 Claim, 7 Drawing Sheets

HAIR ORGANIZER

BACKGROUND OF THE INVENTION

1. Field of the Invention

This invention is related to a hair organizer and in particular to one which can be easily used for holding long hair in position.

2. Description of the Prior Art

Although hair fasteners are indeed well known, they suffer from several drawbacks. In the first place, many known fasteners are difficult to apply. In addition, they do not remain reliably in place and the amount of hair which can be fastened is limited. Certain types of hair fasteners are, in fact, dangerous since they have relatively sharp points ad if worn while sleeping, for example, may injure the wearer. Furthermore, certain known fasteners make it relatively difficult to provide desirable air arrangements and to attach to the hair decorative devices which the wearer might wish to use.

Therefore, it is an object of the present invention to provide a hair organizer which can obviate and mitigate the above-mentioned drawbacks.

SUMMARY OF SAID INVENTION

This invention is related to a hair organizer.

According to a preferred embodiment of the present invention, a hair organizer includes an envelope made of cloth and having an intermediate portion formed with a pocket by stitching; said pocket having a central portion formed with an opening, and an axial member having an intermediate portion formed with a slot, said axial member being fitted in said pocket with said opening stitched around an inner periphery of said slot, whereby one's long hair can be easily held in position without a hair clip.

It is the primary object of the present invention to provide a hair organizer which can be used for holding long hair in position.

It is another object of the present invention to provide a hair organizer which is easy to use.

It is still another object of the present invention to provide a hair organizer which can be easily used for holding long hair in position.

It is still another object of the present invention to provide a hair organizer which is simple in construction.

It is a further object of the present invention to provide a hair organizer which is low in cost. The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
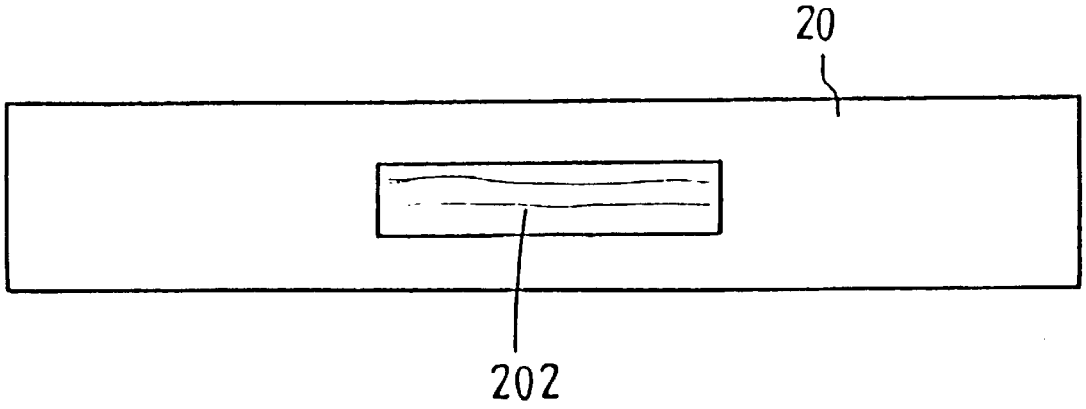
FIG. 1 illustrates an axial member of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
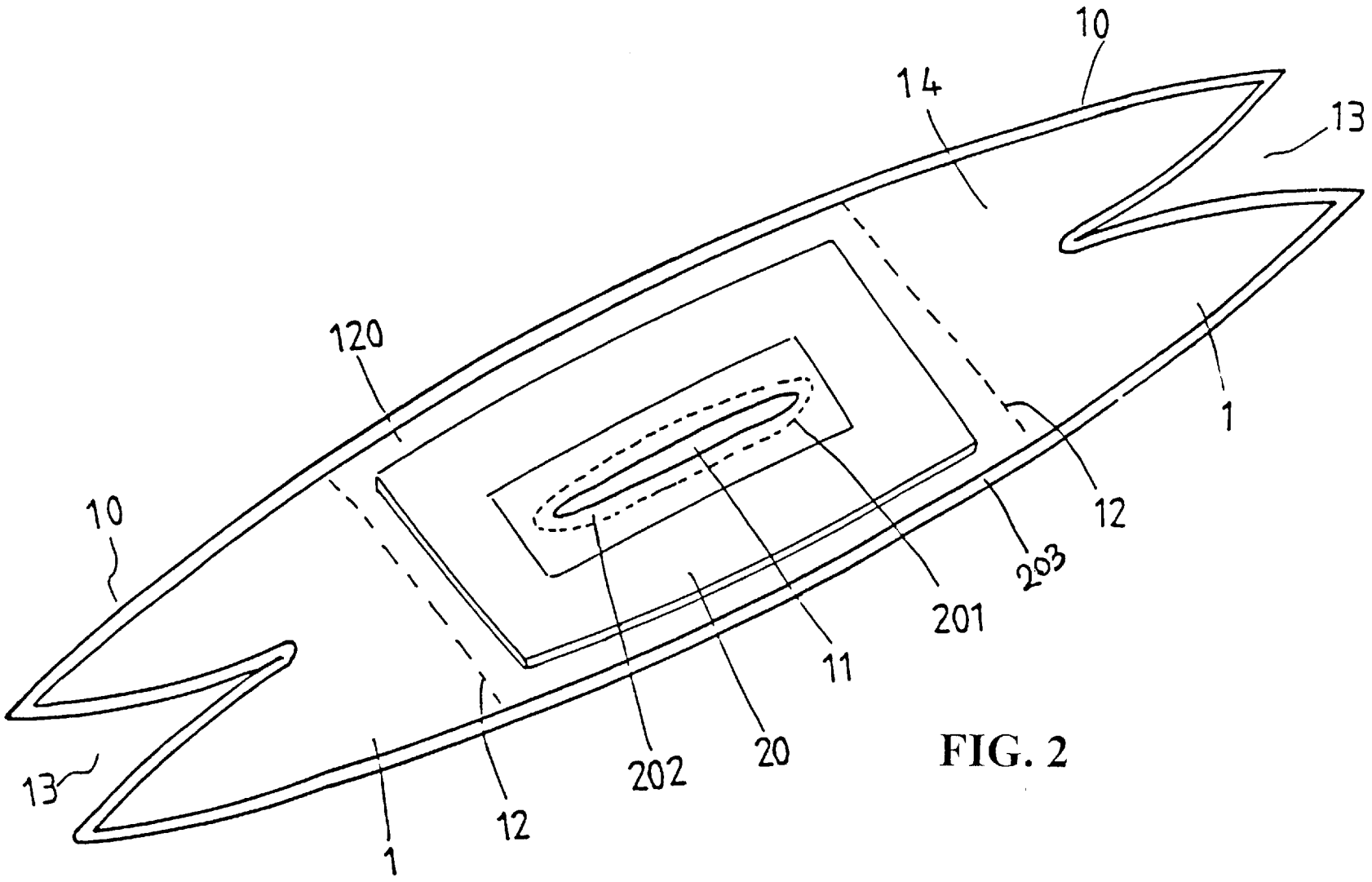
FIG. 2 is a perspective view of a first preferred embodiment according to the present invention.

With reference to the drawings and in particular to FIGS. 1 and 2 thereof, the hair clip according to the present invention generally comprises an envelope 14 and an axial member 20. The envelope 14 is made of cloth which is made of two sheets 1 stitched together along the edge 203. Both ends of the envelope 14 are each formed with a V-shaped notch 13. The intermediate portion of the envelope 14 is stitched along two opposite lines 12 so as to form a pocket 120.

Figure 1A:
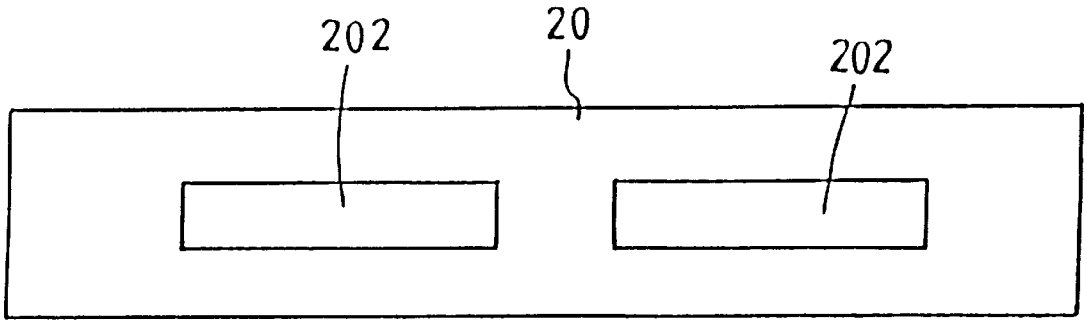
FIG. 1A illustrates a second preferred embodiment of the axial member.

The axial member 20 with one slot 202 (see FIG. 1) or with two slots 202 (see FIG. 1A) is fitted in the pocket 120. The axial member 20 is made of flexible material so that it can be twisted to roll the hair as shown in FIGS. 5, 5A, 6A and 6B.

Figure 3:
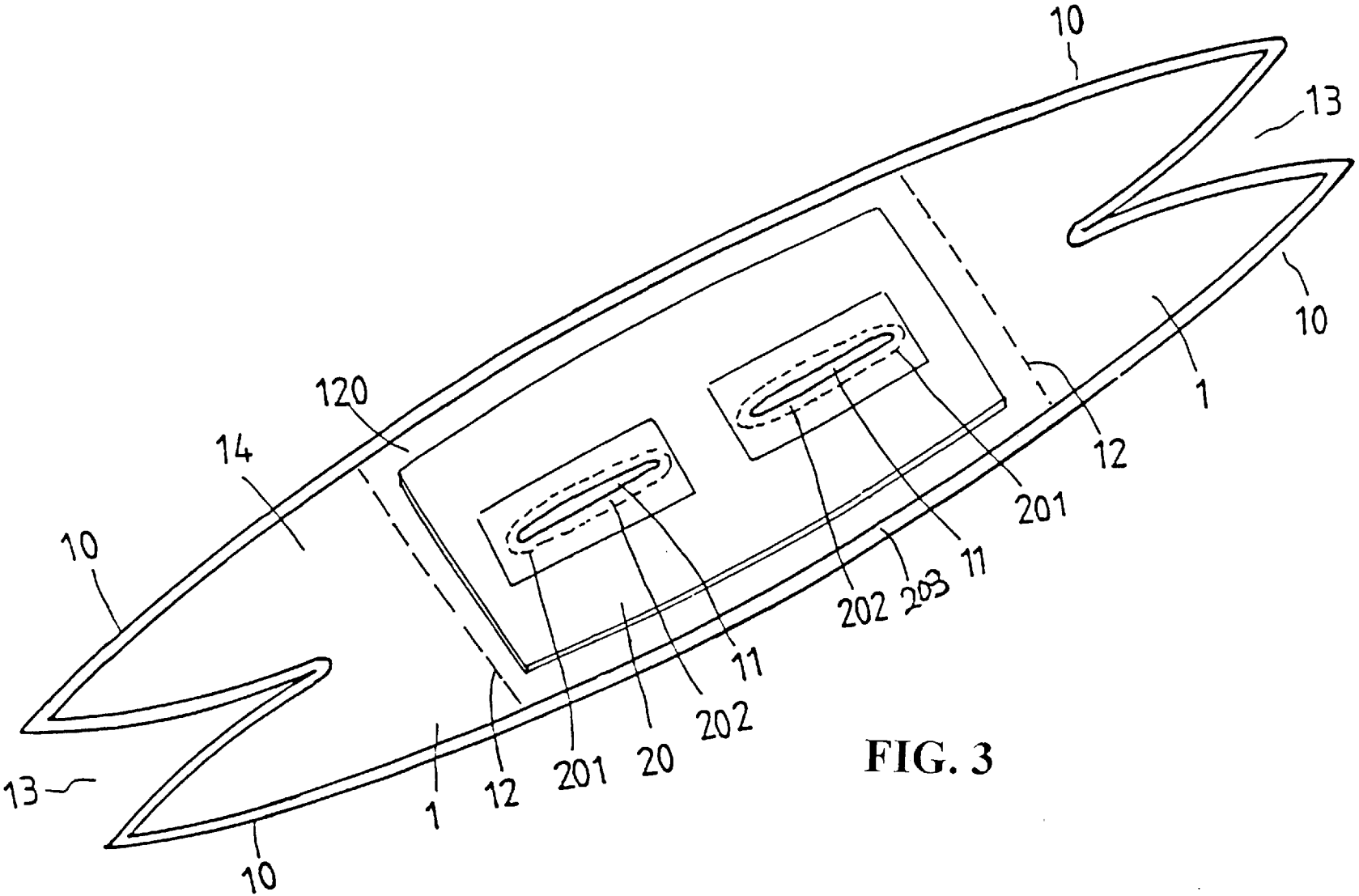
FIG. 3 is a perspective view of a second preferred embodiment according to the present invention.

The inner circumference of the slot 202 of the axial member 20 is stitched along a line 201 to form an opening 11 at a fixed position. As the axial member 20 is made of flexible material, the present invention can be twisted to arrange and hold the hair as desired. FIG. 3 illustrates a second preferred embodiment of the present invention. As shown, the axial member 20 is formed with two slots 202 for arranging and holding hair as desired.

Figure 4:
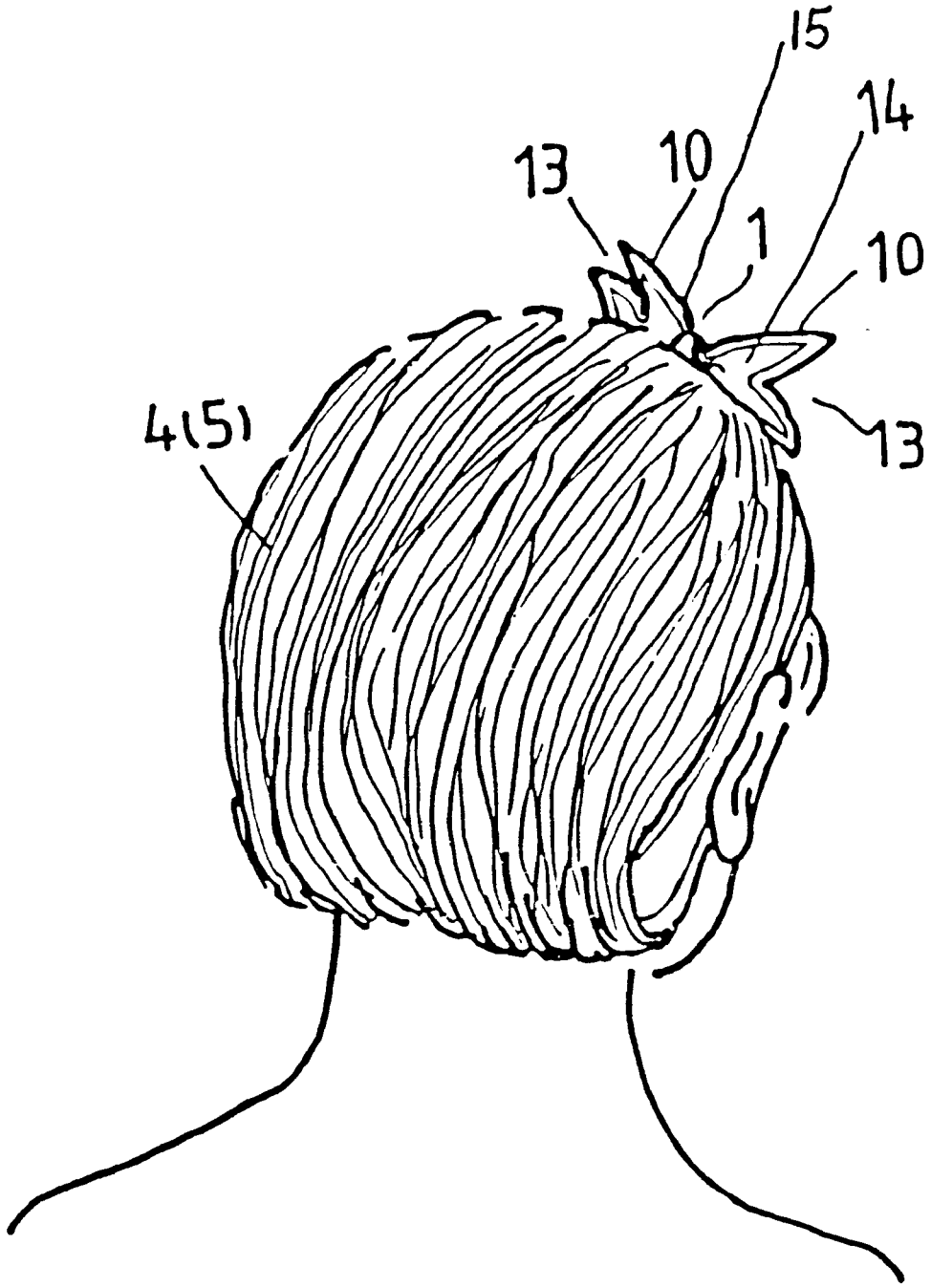
FIGS. 4, 5A, 5B, 6A and 6B are working views of the present invention.
Figure 5B:
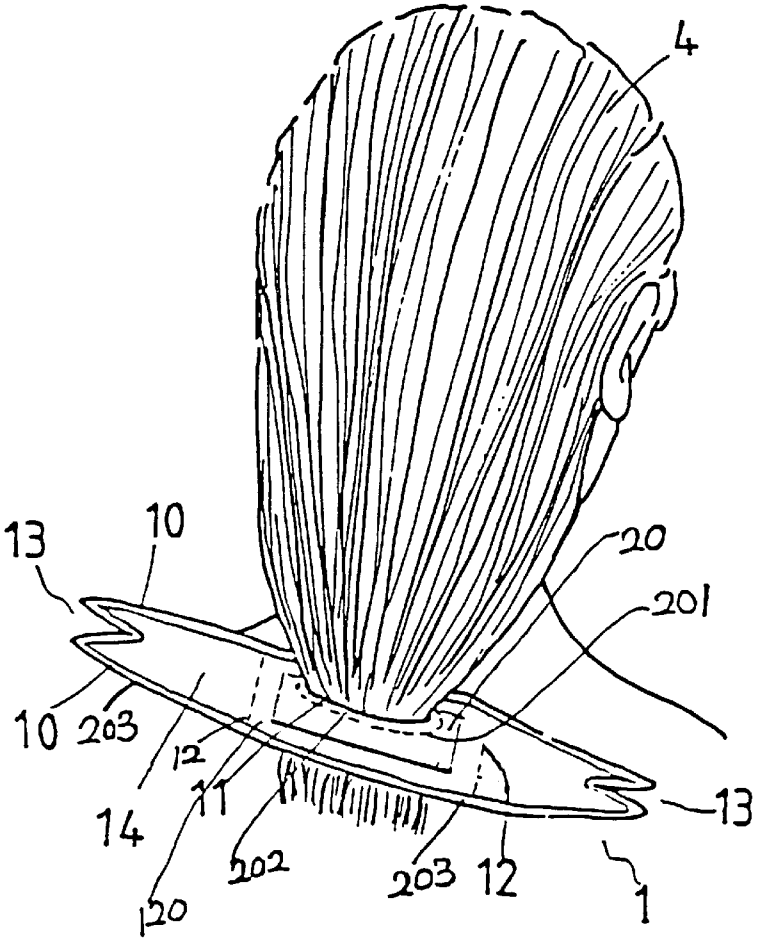
Figure 5A:
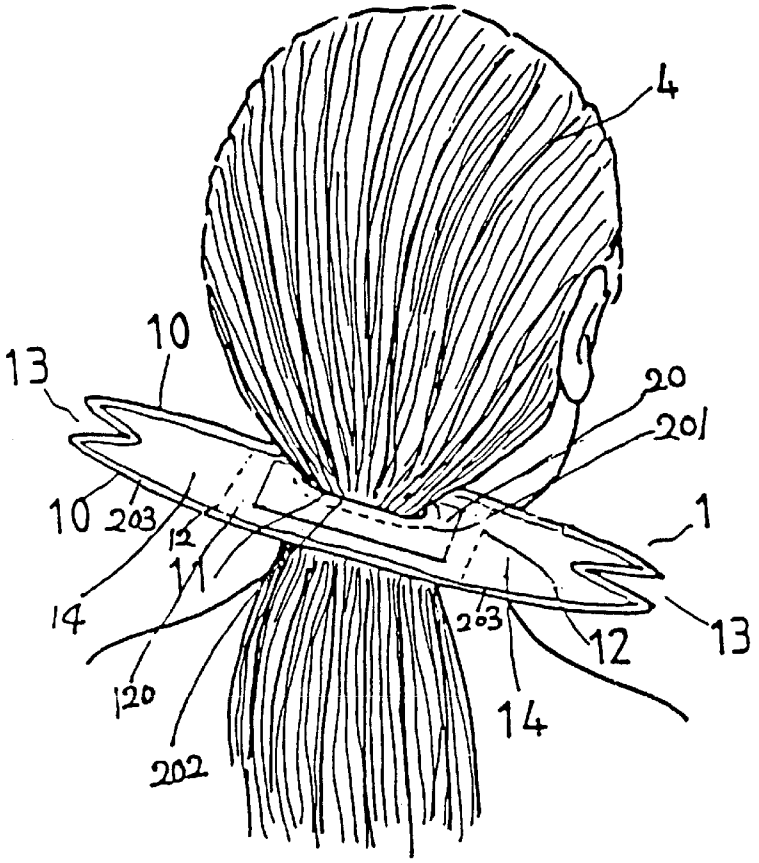
Figure 6B:
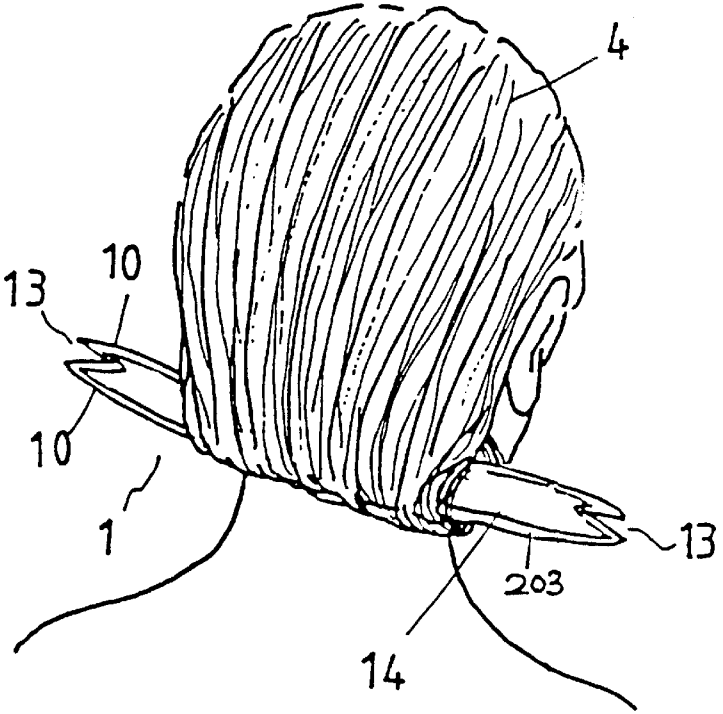
Figure 6A:
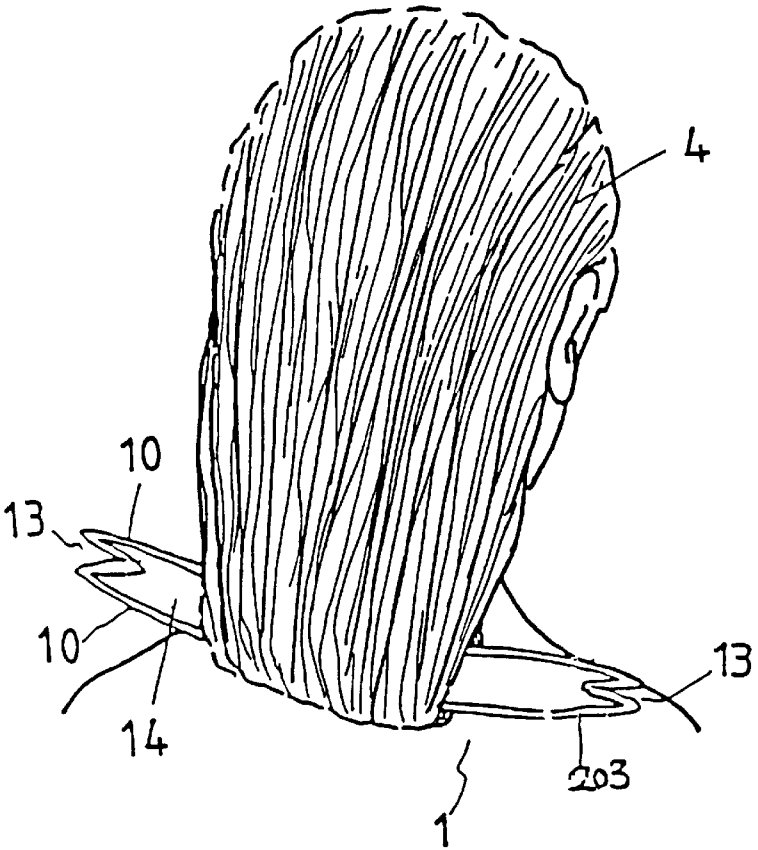
Figure 7:
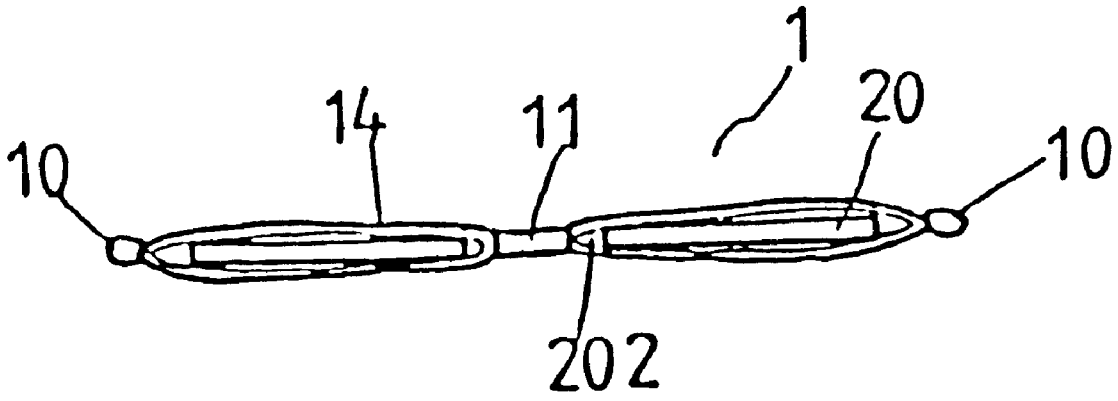
FIG. 7 is a sectional view of the present invention.

FIG. 4 illustrates how to arrange the long hair style 4 into short hair style 5. As illustrated, the hair is first moved over the head in front of the face and then twisted downward with the present invention to hold the hair in position. Thereafter, the forked tails 13 of the present invention are tied together to hold the hair in position. In addition, a decoration in the shape of a butterfly 15 is mounted on the envelope 14 to decorate the hair. FIGS. 5A, 5B, 6A and 6B illustrate to use the present invention to hold long hair. As shown, the hair is first passed through the opening 11 and twisted inwardly with the present invention and then the forked tails 13 at both ends of the present invention are tied together to hold the hair thereby enabling the hair to be held in position without any hair clip.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spint of the present invention.

I claim:

1. A hair organizer comprising:

an envelope made of cloth and having an intermediate portion formed with a pocket by stitching, said pocket having a central portion formed with an opening, said envelope having two forked tails at two opposite ends thereof; and an axial member made of flexible material and having an intermediate portion formed with a first slot close to an end of said axial member and a second slot close to another end of said axial member, said axial member being fitted in said pocket with said opening stitched around an inner periphery of said slot.

* * * * *